United States Patent [19]

Terzian

[11] Patent Number: 4,884,991

[45] Date of Patent: Dec. 5, 1989

[54] POSEABLE SOFT DOLL

[75] Inventor: Rouben T. Terzian, Chicago, Ill.

[73] Assignee: Breslow, Morrison, Terzian & Associates, Inc., Chicago, Ill.

[21] Appl. No.: 308,438

[22] Filed: Feb. 9, 1989

[51] Int. Cl.[4] ..... A63H 3/02

[52] U.S. Cl. ..... 446/369; 446/371; 446/384

[58] Field of Search ..... 446/371, 370, 369, 166, 446/167, 384, 372, 373

[56] References Cited

U.S. PATENT DOCUMENTS

| | | | |
|---|---|---|---|
| 1,659,720 | 2/1928 | Cate | 446/369 |
| 2,252,077 | 8/1941 | Katz | 446/369 |
| 2,997,810 | 8/1961 | Bellas | 446/369 |
| 3,748,779 | 7/1973 | Cherk et al. | 446/370 |
| 3,977,121 | 8/1976 | Goldfarb et al. | 446/369 |
| 4,296,567 | 10/1981 | Kamar | 446/369 |
| 4,575,351 | 3/1986 | Gonzalez | 446/371 |
| 4,758,200 | 7/1988 | Von Moltke | 446/371 |

*Primary Examiner*—Mickey Yu

*Attorney, Agent, or Firm*—John S. Pacocha

[57] ABSTRACT

A readily and realistically poseable baby doll has shells made of double layers of stretch fabric for the torso, arms and legs. For the most part, each of the shells is filled with a very fine, freely flowable particulate filler. However, a less freely flowable stuffing material, such as DuPont Certified QUALLOFIL pillow stuffing material, is also inserted in particular locations. Stitched joints, inboard of the periphery of adjacent portions of the limbs, are used to connect the arms and legs to the torso. Atop a neck portion of the torso is a generally bulbous enlargement that contains the less freely flowable stuffing material and is compressible to fit inside and retain a hollow molded vinyl head on the neck and torso. Molded vinyl hands and feet may be attached to the free ends of the arms and legs.

2 Claims, 1 Drawing Sheet

POSEABLE SOFT DOLL

BACKGROUND OF THE INVENTION

1. Field of the Invention

This invention relates to dolls and more particularly to soft stuffed dolls.

2. Background Art

Soft dolls stuffed with rags, cotton batting, foam, and particulate fillers such as beans are old in the art. U.S. Pat. Nos. 3,678,616 and 3,882,633 issued July 25, 1972 and May 13, 1975, respectively, to Goldfarb et al. disclose a doll having a body formed of cloth and filled with a solid particulate filler to about eighty to ninety percent of its volume. Since the arms and legs are in communication with the torso to permit the flow of particulate filler, a vacant area adjacent the top of the doll's body is left when all of the filler material has settled downwardly with the doll in a standing position. The body has a pronounced enlarged rear protrusion in the rump area of the doll to provide a low center of gravity. A head is affixed to the body and a stabilizer affixed to the head extends down into the particulate filler in the body for stabilizing the head relative to the body. There remains a need, however, for a soft, readily poseable, particulate filled doll having substantially proper proportions and body parts that generally retain their proper shape.

SUMMARY OF THE INVENTION

The present invention is concerned with providing a readily poseable baby doll comprising shells formed of double layers of stretch fabric for the torso, arms and legs. Each of the shells is mostly filled with a very fine, freely flowable particulate filler, but a less freely flowable stuffing material, such as DuPont Certified QUALLOFIL pillow stuffing material, is also inserted in particular locations. Stitched joints, inboard of the periphery of adjacent portions of the limbs, are used to connect the arms and legs to the torso. A generally bulbous enlargement atop the neck portion of the torso shell contains the less freely flowable stuffing material and is compressible to fit inside and retain a hollow molded vinyl head on the neck and torso. Molded vinyl hands and feet may be attached to the free ends of the arms and legs.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
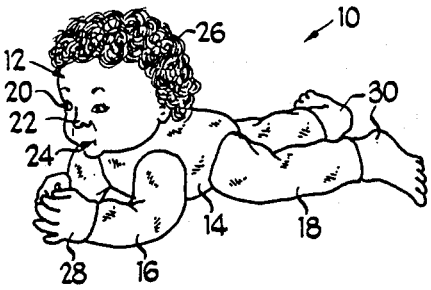
FIG. 1 is a perspective view of an embodiment of the present invention in one exemplary pose.

Referring now to the drawings in which like parts are designated by like reference numerals throughout the several views, FIG. 1 shows a doll 10 having a hollow, molded vinyl head 12, a torso 14, arms 16 and legs 18. Head 12 includes molded eyes 20, nose 22, lips 24 and other facial features. Secured to the top of head 12 by rooting, adhesive or the like is simulated hair 26. Attached on the free ends of each of the arms 16 are molded vinyl hands 28 while molded vinyl feet 30 are attached to the free ends of each leg 18.

Figure 2:
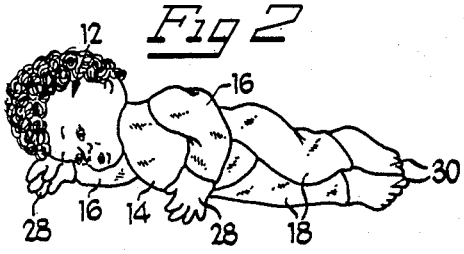
FIG. 2 is a perspective view of the embodiment in another exemplary pose.
Figure 3:
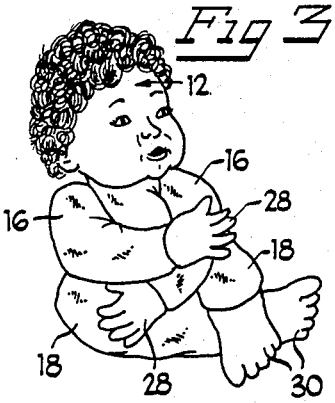
FIG. 3 is a perspective view of the embodiment in yet a third exemplary pose.

FIG. 1 shows doll 10 in a prone position with head 12 generally upright and the upper part of torso 14 elevated by the support of arms 16. In FIG. 2, doll 10 is shown lying on one side with head 12 supported on one of arms 16, the other arm falling down across the abdomen portion of the torso and one leg partially crossed over another. As illustrated in FIG. 3, doll 10 is posed in a seated position with arm 16 crossed in front of the torso and one leg 18 crossed over the other. Doll 10 may be posed in numerous other realistic positions.

Torso 14, arms 16 and legs 18 are each made so that they simulate the torso, arms and legs of a generally properly proportioned human infant. While torso 14 does have a generally bulbous enlargement 32 atop a neck portion 33 that extends upwardly from torso 14, enlargement 32 is obscured from view once head 12 is attached. Hollow flexible shells 34, 36 and 38 are formed for torso 14, arms 16 and legs 18, respectively, from pattern cut pieces of two layers 40 and 41 of a two way stretch fabric sewn together along a seam 42.

Each of the torso, which includes the neck and bulbous enlargement, arms and legs are self-contained and are, for the most part, filled with a readily flowable, particulate filler 44 comprising generally spherical balls having a diameter of about sixty-thousands or one-sixteenth of an inch or less. This fine spherical particulate readily flows within the torso or appendage that it is contained. Filling doll 10 for the most part with fine particulate filler 44 provides the weight and feel of a real baby and allows doll 10 to be posed in numerous realistic positions. Conveniently, the double layer shells, one within the other, help prevent any leakage of the fine particulate.

Figure 4:
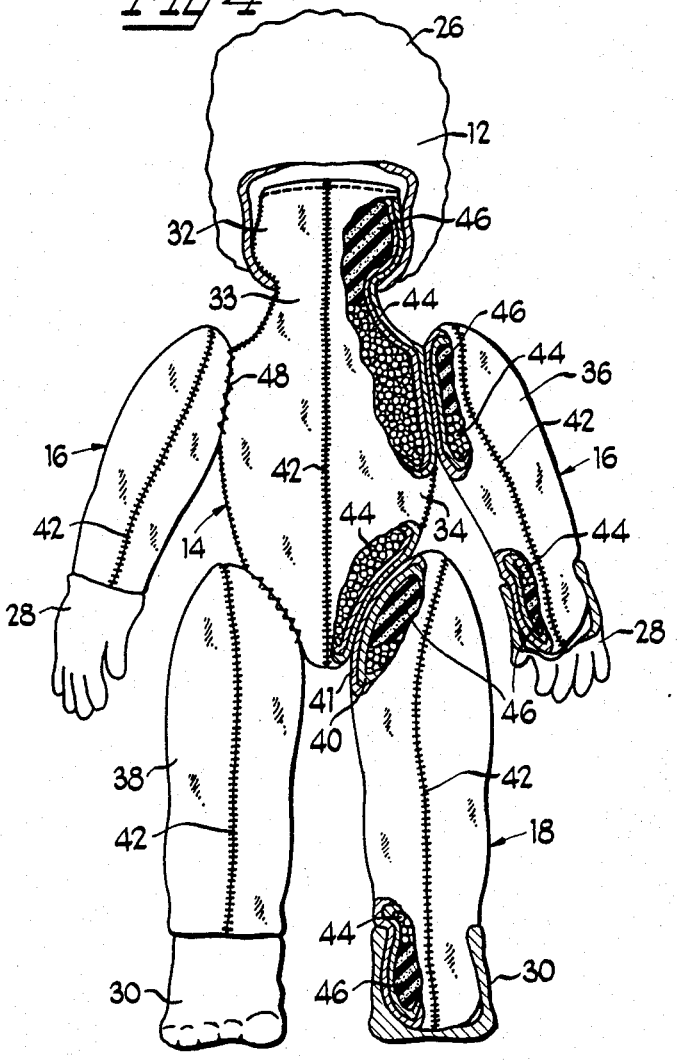
FIG. 4 is an enlarged scale, front elevational view of the embodiment in a standing pose, partially broken away.
Figure 5:
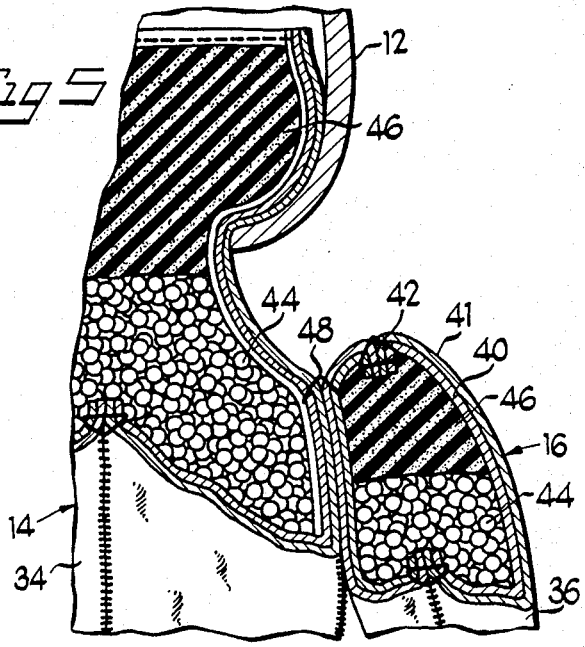
FIG. 5 is an enlarged scale, fragmentary view, partially broken away, showing a shoulder joint.
Figure 6:
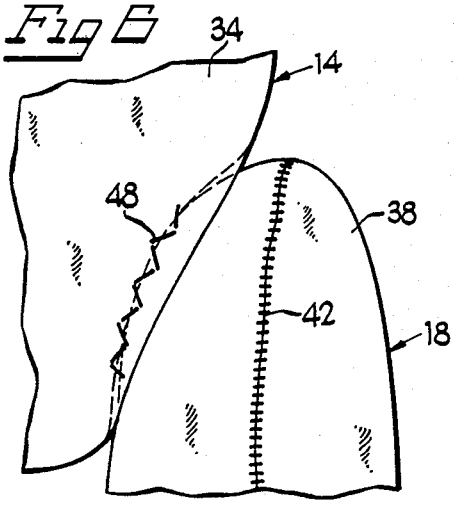
FIG. 6 is an enlarged scale, fragmentary view showing a hip joint.

In order to provide for flexibility of each of the torso, arms and legs, the fabric shells cannot be overstuffed with the particulate. Accordingly, a void can occur at one end or the other of the arms or legs. Such a void would result in an unrealistic sagging of the fabric shell skin and to avoid such occurrences, a small amount of a less freely flowable stuffing material such as foam or DuPont Certified QUALLOFIL pillow stuffing material 46 is inserted in the extremities of the arms and legs as illustrated in FIG. 4. Stuffing material 46 is compressible but readily returns to its normal, expanded state. Accordingly, when particulate filler 44 flows towards one end of an extremity, it will compress stuffing material 46 at that end while the stuffing material at the other end expands to fill the void that would otherwise by left there.

Bulbous enlargement 32 is also filled with less freely flowable stuffing material 46. To attach head 12 to doll 10, bulbous enlargement 32 is compressed and forced into the hollow, vinyl head through an opening in its bottom. Stuffing material 46 then expands to its normal state increasing the size of bulbous enlargement 32 which, as is best illustrated in FIG. 4, is significantly larger than the opening in the bottom of head 12 and substantially fills the bottom portion of head 12. Thus, head 12 is retained on doll 10 by bulbous enlargement 32. If desired, head 12 could be further secured to doll 10 by stitching or adhesives. However, such additional attachment has not been found to be necessary and would limit the ability to move head 12 relative to torso 14 to further enhance the poseability of doll 10.

Arms 16 and legs 18 are attached to torso 14 by stitching 48. All of stitched joints 48 enclose an area that is significantly less than the area of the appendage that would abut the torso if the appendage merely rested upon the torso as in the case of the uppermost arm and leg in FIG. 2. Hence, stitched joints 48 are inboard of the periphery of adjacent portions of the connected limbs. Such smaller joints permit a greater range of movement of the limbs relative to the torso and hence increase the overall poseability of doll 10.

Vinyl hands 28 and feet 30 are hollow and each has an opening through which the free end of a respective one of the arms and legs containing stuffing material 46 may be inserted. However, unlike head 12, it is more convenient to further attach the hands and feet to the arms and legs, respectively, by stitching, adhesive or the like.

While a particular embodiment of the preset invention has been shown and described, changes and modifications will occur to those skilled in the art. It is intended in the appended claims to cover all such variations and modifications as fall within the true spirit and scope of the present invention.

What is claimed as new and desired to be secured by Letters Patent is:

1. A soft doll comprising in combination:

a plurality of hollow body parts formed of a flexible material;

each of the body parts defining a volume;

means connecting the body parts together to simulate a torso and limbs;

a freely flowable particulate filler within the body parts;

the particulate filler having a generally spherical pieces approximately sixty-thousands of an inch in diameter or less;

the particulate filler occuping less than all of the volume of each of the body parts; and the remaining volume of each of the body parts being filled with a relatively less freely flowable, normally expanded, readily compressible stuffing material that readily returns to its normal expanded condition when a compressing force is removed.

2. The doll of claim 1 in which:

the body parts include limbs; and the stuffing material is inserted at the extremities of the limbs.

* * * * *